US010724689B2

(12) United States Patent
Roska et al.

(10) Patent No.: US 10,724,689 B2
(45) Date of Patent: Jul. 28, 2020

(54) LOADING SYSTEM AND METHOD OF USE THEREOF

(71) Applicant: ROSKA DBO INC., Grande Prairie (CA)

(72) Inventors: Clayton Roska, Grande Prairie (CA); Duane Edward Weiser, Grande Prairie (CA); Ronald Michael Kowalyk, Grande Prairie (CA); Gregory Thomas Nesom, High River (CA); Terry Wesley Quackenbush, Grande Prairie (CA); Clinton Kent Rowland, Grande Prairie (CA); Thomas Daniel Eidt, Edson (CA); Kelly Murray Gitzel, Grande Prairie (CA); Connor John Martin, Grande Prairie (CA); Curtis A. Moore, Grande Prairie (CA); Stephen Michael LaFond, Wembley (CA)

(73) Assignee: ROSKA DBO INC., Grande Prairie, AB (CA)

( * ) Notice: Subject to any disclaimer, the term of this patent is extended or adjusted under 35 U.S.C. 154(b) by 0 days.

(21) Appl. No.: 15/936,733

(22) Filed: Mar. 27, 2018

(65) Prior Publication Data

US 2018/0283616 A1 Oct. 4, 2018

Related U.S. Application Data

(60) Provisional application No. 62/479,912, filed on Mar. 31, 2017.

(51) Int. Cl.

| | |
|---|---|
| ***F17C 13/12*** | (2006.01) |
| ***F17C 5/02*** | (2006.01) |
| ***F17C 13/04*** | (2006.01) |
| ***B65D 88/00*** | (2006.01) |
| ***F17C 6/00*** | (2006.01) |

(Continued)

(52) U.S. Cl.
CPC ..... *F17C 13/126* (2013.01); *B65D 88/00* (2013.01); *F17C 5/02* (2013.01); *F17C 6/00* (2013.01);

(Continued)

(58) Field of Classification Search
None
See application file for complete search history.

(56) References Cited

U.S. PATENT DOCUMENTS

| | | | | |
|---|---|---|---|---|
| 3,864,452 A | | 2/1975 | Chi et al. | |
| 4,098,303 A | * | 7/1978 | Gammell | B67D 7/0476 141/192 |

(Continued)

FOREIGN PATENT DOCUMENTS

| | | | | |
|---|---|---|---|---|
| CA | 2349349 A1 | * | 11/2002 | F17C 5/00 |
| CA | 2349349 A1 | | 11/2002 | |
| JP | 11301786 A | | 11/1999 | |

*Primary Examiner* — Jessica Cahill
*Assistant Examiner* — Christopher M Afful
(74) *Attorney, Agent, or Firm* — Field LLP

(57) ABSTRACT

A system is provided for loading one or more transport tank, the system including one or more load lines for connecting between on-site storage tanks or vessels and the transport tanks; one or more vapour return lines for connecting between the transport tanks and an on-site flare or downstream units; an oxygen deficient medium source; one or more oxygen deficient medium blend supply lines connectable to each of the vapour return lines; a HMI/PLC for automation and control of the operations of the system; and a control panel in communication with the HMI/PLC for starting and stopping operation of the system. Gases displaced from the transport tanks during loading can be sent directly to flare or downstream units. A method is also provided for loading a fluid from one or more on-site storage tanks or vessels to one or more transportation tanks.

13 Claims, 2 Drawing Sheets

(52) U.S. Cl.
CPC ..... *F17C 13/04* (2013.01); *F17C 2205/0367* (2013.01); *F17C 2221/032* (2013.01); *F17C 2221/033* (2013.01); *F17C 2223/0153* (2013.01); *F17C 2223/033* (2013.01); *F17C 2223/043* (2013.01); *F17C 2223/046* (2013.01); *F17C 2227/044* (2013.01); *F17C 2250/0447* (2013.01); *F17C 2250/0626* (2013.01); *F17C 2250/0636* (2013.01); *F17C 2250/0689* (2013.01); *F17C 2260/035* (2013.01); *F17C 2260/044* (2013.01); *F17C 2265/061* (2013.01); *F17C 2270/0134* (2013.01); *F17C 2270/0171* (2013.01)

(56) References Cited

U.S. PATENT DOCUMENTS 5,054,526 A * 10/1991 Perkins ..... B63J 2/14 114/74 A
5,151,111 A * 9/1992 Tees ..... B67D 7/0476 141/52
5,884,675 A * 3/1999 Krasnov ..... F17C 5/06 141/18
5,988,232 A * 11/1999 Koch ..... B67D 7/0486 141/59
6,193,786 B1 * 2/2001 Henderson ..... B01D 19/0005 55/356
6,394,149 B1 * 5/2002 Parsons ..... B67D 1/045 141/289
6,443,166 B1 9/2002 Tunney et al.
6,532,684 B1 3/2003 Tunney et al.
6,857,447 B2 2/2005 Olander et al.
6,901,941 B2 6/2005 Gershtein et al.
7,252,700 B1 8/2007 Strahan
8,480,812 B2 7/2013 Nath et al.
2002/0088504 A1 * 7/2002 Sauer ..... A62C 3/06 141/64
2010/0000252 A1 1/2010 Morris et al.
2010/0089071 A1 * 4/2010 Hofmann ..... B65D 90/34 62/48.1
2014/0345708 A1 11/2014 Oldham et al.

* cited by examiner

CLEAN AIR/PURGE SKID PFD

TRANSPORTATION TANK
PACKAGE LIMITS
501 CONTROL PANEL
OIL
WATER
START
STOP
HMI/PLC
ZSO 730
PI 1002
4
PI 1003
PS 1003
PI 1004
PS 1004
2B
2A
PCV 710
PCV 710
M2
M1
510
520
520A
520B
XV 720
XV 700
XV 720
XV 700
O2 SENSOR
AIT 1001
PI 710
FLARE
WATER
OIL
500 O2 Deficient Medium source
ON-SITE FKO VESSEL
ON-SITE FLARE, COMBUSTOR INCINERATOR
ON-SITE PRODUCED WATER STORAGE TANK
ON-SITE HYDROCARBON STORAGE TANK

CLEAN AIR/LOAD SKID PFD

TRANSPORTATION TANK
PACKAGE LIMITS
501
CONTROL PANEL
OIL
WATER
START
STOP
HMI/PLC
ZSO 730
PCV 7101
M3
4
510
PI 1003
PS 1003
PI 1004
PS 1004
XV 7201
XV 7001
2B
2A
$O_2$ SENSOR
AIT 1001
M2
M1
FLARE
WATER
OIL
500
$O_2$ Deficient
Medium source
ON-SITE
FKO
VESSEL
ON-SITE
FLARE, COMBUSTOR
INCINERATOR
ON-SITE
PRODUCED WATER
STORAGE
TANK
ON-SITE
HYDROCARBON
STORAGE
TANK

LOADING SYSTEM AND METHOD OF USE THEREOF

FIELD OF THE INVENTION

The present invention relates to an automated system for safe loading of transportation tanks for carrying hydrocarbons, hydrocarbon by-products and other volatile fluids, and for methods of using the same.

BACKGROUND OF THE INVENTION

During loading of hydrocarbons, hydrocarbon by-products or other volatile or hazardous fluids from onsite storage to a transport tank, there is always a displacement of the gaseous environment from inside the transport tank as it is getting filled. In the case of volatile fluids, there is also off-gassing, or the release of vapours off of the volatile fluid.

As fluids are loaded, these gaseous vapors, be they displaced vapours or off-gassing vapours, are typically released from the vent system on the transport tank. Typically, in industry practice, where such gas is "sweet" (for example, containing less than 5 ppm hydrogen sulfide) venting to atmosphere has been permitted by industry and regulatory agencies. In the case of systems with "sour" gas (for example, containing greater than 5 ppm hydrogen sulfide), vented gas vapors have been traditionally directed to sweetening or scrubbing units.

With the industry norms as described above there are inherent dangers and issues:

1. During loading, explosive, flammable and hazardous gases are released into the atmosphere from the transportation tank or scrubber vent;
2. The gases being released in loading can create a localized oxygen deficient atmosphere, which is a hazardous condition for workers onsite;
3. Odour complaints from adjacent land owners;

While tank gases could be flared to deal with the above issues, transportation tanks arriving on site with oxygen present cannot be safely connected to a flare or vapour recovery unit due to potential explosive conditions.

Furthermore, in the case of on-site sweetening units, there can be hazards related to the disposal of the rich sweetening chemicals once spent. There are further concerns with hazardous, hydrogen sulphide atmospheres being created and/or production outages when the sweetening chemicals are spent at inopportune times, or prematurely.

For the purposes of the present invention transport tanks are intended to include any mobile tank systems such as, for example, tank trucks, tank trailers or rail cars or pressurized floating containers.

CA Patent Appl. No. 2,349,349 is directed to a method and apparatus for evacuating a section of a natural gas pipeline, but does not address fluids loading or unloading and the need for dealing with gas emissions during such processes. U.S. Pat. No. 8,480,812 teaches a process for removing hydrocarbon contaminants and noxious gases from catalytic reactors in the vapour phase without using steam. US Patent Application No. 2010/0000252 is directed to a process for the loading, processing and conditioning of raw production gas, the production of compressed gas liquids and the storage, transport and delivery of pipeline quality gas and other products to market. However, it does not relate to a system for transport tank loading or unloading. U.S. Pat. No. 6,901,941 is directed to a vessel for the storage and transportation of bulk volumes of fluid and methods for using the same. U.S. Pat. No. 7,252,700 is directed to a method and mobile system for cleaning dirty gas from a newly stimulated gas well.

There is a need therefore to develop improved safe, loading systems and operational methods that can deal with vapour emissions from transport tanks.

SUMMARY

A method is further provided for loading a fluid from one or more on-site storage tanks or vessels to one or more transport tanks. The method involves the steps of providing a loading system comprising a source of oxygen deficient medium, one or more vapour return lines to flare or downstream units and a central HMI/PLC; purging the transport tank with oxygen deficient medium prior to loading; loading the transport tank with fluid; sending gases displaced from the transport tank during loading directly to flare or downstream units; and automatically monitoring and controlling of the operations of the system via the HMI/PLC.

A further system is provided for loading one or more transport tank. The system comprises one or more load lines for connecting between on-site storage tanks or vessels and the transport tanks; one or more vapour return lines for connecting between the transport tanks and an on-site flare or downstream units; an oxygen deficient medium source; one or more oxygen deficient medium blend supply lines connectable to each of the vapour return lines; a HMI/PLC for automation and control of the operations of the system; and a control panel in communication with the HMI/PLC for starting and stopping operation of the system. Gases displaced from the transport tanks during loading can be sent directly to flare or downstream units.

A further method is provided for loading a fluid from one or more on-site storage tanks or vessels to one or more transportation tanks. The method involves the steps of providing a loading system comprising one or more load lines connectable between the storage tanks or vessels and the transportation tanks, one or more vapour return lines connectable between the transportation tanks and a flare, a source oxygen deficient medium connectable to the one or more vapour return lines; and a central HMI/PLC; loading the transport tank with fluid; blending the vapour return lines with oxygen deficient medium; sending gases displaced from the transport tank during loading directly to flare or downstream units; and automatically monitoring and controlling of the operations of the system via the HMI/PLC.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. The drawings depict only typical embodiments of the invention and are therefore not to be considered limiting of its scope. In the drawings.

Figures 1, 3:
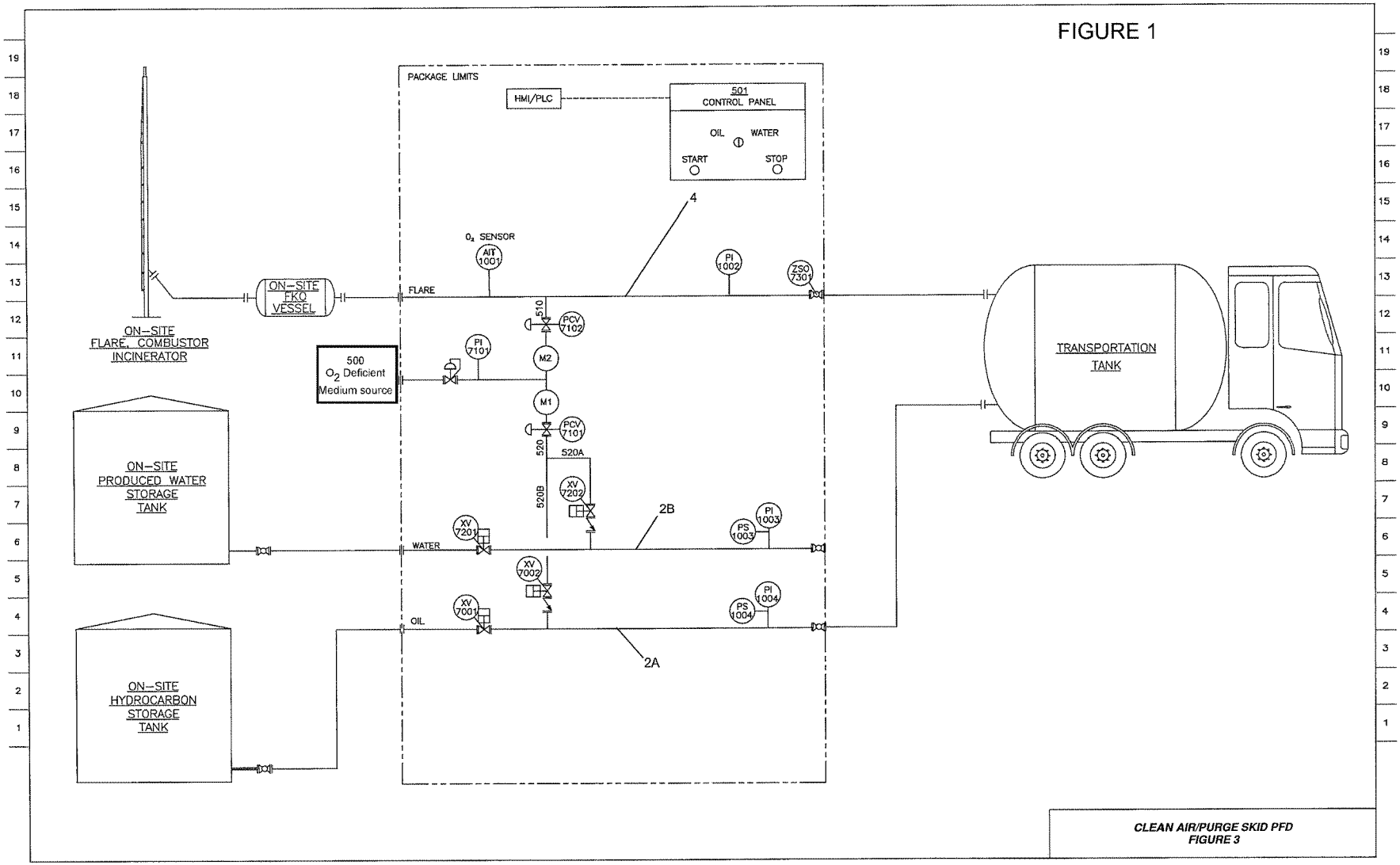
FIG. 1 is a schematic diagram of a first embodiment of a system of the present invention, as connected to on-site storage tanks or vessels and to a transport tank.

The drawings are not necessarily to scale and in some instances proportions may have been exaggerated in order more clearly to depict certain features.

DETAILED DESCRIPTION OF VARIOUS EMBODIMENTS

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects.

The present safe loading system relates to safe handling of gas emissions during the fluids loading or unloading of transport tank systems such as tank trailers.

The present system can be a fixed system located on-site or it can be a portable system that can be brought to and removed from the on-site location. In a preferred embodiment, the present system is portable and is more preferably skid or trailer mounted to provide portability for transportation to multiple fixed storage sites. The fluids for loading or unloading are typically sweet or sour hydrocarbons, sweet or sour hydrocarbon by-products such as produced water, although any number of further sweet or sour volatile fluids could be loaded or unloaded using the system of the present invention.

The safe loading system of the present invention allows for a number of tailored loading and unloading operations to be controlled depending on such factors as fluid type, transport tank type, working conditions etc.

The present system further eliminates the practice of having a transport tank vent to atmosphere, either directly or after a sweeting process during loading or unloading. Instead, displaced gasses and off-gas vapours can be sent directly to a flare or downstream units during loading or unloading, thereby reducing vapour emissions being released in vicinity of drivers of the transport tanks, operators and any other personnel present during loading and unloading. The above goal is achieved by uniquely using the present system to purge the vapour content of the transport tank with an oxygen deficient gas medium before loading. The oxygen deficient gas, together with any off-gassing vapours displaced from the transportation tank during loading are now well below the lower explosive limit (LEL) and can then be sent directly to flare or downstream units. This also reduces the need for sour gas sweetening units on-site, since the sour gas can be flared.

In purging the vapour content of the transport tank, the atmosphere within the transport tank is brought down to below LEL so that during the loading process the gas and vapours displaced from the transportation tank can be directed to a flare, combustion use, pressure vessel or vapour recovery unit.

When loading sour fluid or condensate, the present system allows for vapours to be sent directly to a flare stack, or to downstream units including a vapour recovery unit, a combustion unit for energy generation or back into a pressure vessel that may optionally be provided on-site. Therefore, it is to be understood that for the purposes of the present invention, the term "flare or downstream units" used throughout this description is intended to include flare stack, a vapour recovery unit, a combustion system or a pressure vessel.

The source of oxygen deficient gas can be any source well known to those skilled in the art, and such range of sources are included in the scope of the present invention. By way of example only and without intending to be limiting, such oxygen deficient medium can include any inert gas such as nitrogen, argon, xenon, helium, carbon dioxide, natural gas or other gases that fall below the LEL such as methane etc., which can be sourced by provision of gas cylinders on the system, or from other onsite operations. The oxygen deficient medium source can be sized to meet loading capacities and rates for the transport tank to be loaded or off-loaded, or can be oversized to meet a range of transport tank volumes. More preferably, the oxygen deficient medium source can displace a rate of 1-10 $m^3$/min to match typical rates of off-loading or loading of fluid.

In a preferred embodiment, the present system includes a portable nitrogen generation system for nitrogen purging the transport tank prior to loading or during unloading. In this embodiment, the nitrogen system can incorporate any number of nitrogen sources including high a pressure nitrogen bottle mounted on the system, a nitrogen generation unit mounted to the system or a nitrogen membrane package mounted to the system.

More preferably, the present nitrogen system comprises an air compressor which feeds a compressed air storage vessel, which in turn feeds a nitrogen generation unit. The nitrogen generated can then be stored in a nitrogen storage vessel. In this embodiment, all of these units are mounted to the system of the present invention.

More preferably the flow rate and pressure of the oxygen deficient medium are monitored and regulated, more preferably to maintain oxygen deficient medium pressure within the transport tank to never exceed 175 kPa (25 psi), but to also purge the transport tank within a desired amount of time, which may be in some instances around 10 minutes.

The vapour return lines 4 of the present system have an oxygen sensor AIT 1001 to monitor the composition of gas being vented from the transport tank. In a case where oxygen levels of the vent gas reach an explosive limit, the present system comprises controls to automatically shut down loading of the tank with fluid.

Most preferably, all valves for purging or displacing the volume of the tank are automated and controlled by the HMI/PLC. The valves may be air actuated valves. The vapour return lines 4 can be used for displacing transport tank volume with oxygen deficient medium during unloading. The load lines 2A/2B each comprise a pressure gauge PI1003/PI1004, a purge connection 520A/520B to the oxygen deficient source 500, and valves XV 7201/XV7001 mounted at the connection end from the onsite storage tanks or vessels and valves 50A/50B at the connection end before the loading pump on the transport tank. It should be noted that any number of load lines 2 may be provided on the system, each possibly dedicated to a particular fluid to be loaded or unloaded. But it is also possible to have one or multiple non-dedicated load lines 2 on the system, such that more than one transport tank can be unloaded or loaded at the same time with either the same or different fluids. Oxygen deficient medium can be passed through the load lines for purging the transport tank, during which process displaced gases from the transport tank are vented to atmosphere either directly, or in the case of sour displaced gases, via the scrubber.

The system preferably comprises the control panel 501 by which the driver of the transport tank can indicate the type of fluid being loaded or unloaded and to start or stop the process. The central HMI/PLC can be located on the system, and can be accessed locally or from a remote location from which loading and unloading can be controlled, readings taken and progress displayed.

The present system is fully automated, needing the driver to merely hook up the load lines 2A/2B and vapour return lines 4, indicate on the control panel 501 the type of fluid being loaded and start the process, at which point the central HMI/PLC, taking input from the pressure and flow monitors, oxygen level sensors AIT 1001 and controlling the valving, automatically manages the purging, loading and/or unloading process, until the driver's transport tank level indicator indicates a full load or unload level, or the storage tank is full or empty or from a signal from the fluid metering on the present system, at which point the driver can stop the operation via the control panel. Optionally, the HMI/PLC may also have a manual override such that an operator at the HMI/PLC may remotely control the opening and closing of valves by reading the oxygen level data from the oxygen level monitors.

In a preferred method for loading fluid into a transport tank using the system of the present invention, the transport tank is first located near the system, preferably with the load pump of the truck carrying the transport tank facing the system. Next, the vent of the transport tank is connected to the vapour return lines 4 of the system. In a situation in which the system is being used for the first time at a particular site, the vapour return line 4 of the system that goes to flare or downstream units will also be connected to the on-site flare or downstream units, in other cases, this connection to flare or downstream units is already made. Again, if the system is being used for a first time, then the load lines 2 are connected to the on-site storage tank or vessel that fluid is being loaded to or from. As previously stated, the load line 2 to be connected can be a dedicated load line 2 for a particular fluid from a particular on-site storage tank or vessel, or it can be a universally usable load line. This storage tank or vessel is located on site and could include separation vessels, storage vessels etc. The other end of the load lines 2 is then connected to a load pump located on the transport tank, which in turn pumps into the transport tank. The valve ZSO-7301 on the vapour return line 4 connected to the transport tank is opened as is the valve of the predetermined load line 2A/2B at its connection to the transport tank. Next, the valves XV-7201/XV-7001 on the load line 2A/2B to the on-site storage tanks or vessels are opened. During first site commissioning, the type of fluid being loaded is selected, typically from the options of sweet hydrocarbon, sour hydrocarbon, sweet by-product or sour by-product, which are also programmed into the HMI/PLC. The load pump is started on the transport tank and the system is started from the control panel. At this point of the present method the central HMI/PLC controls and fully automates the loading process.

The vapour return line 4 is opened and the oxygen deficient medium source lines 520A/520B/510 into the load line 2A/2B and to vapor return line 4 are also opened and the load lines are purged by running the oxygen deficient medium through them.

As the displaced gases from the transport tank are purged they are directed to flare or downstream units.

During loading, vent gas oxygen content is continually monitored. The vapour return line 4 is open to vent gases either to the flare or downstream units.

Once the fluid is loaded onto the tank, as indicated by a transport tank level indicator (not shown) on the tank, the load line 2A/2B is shut in at its connection XV7201/XV7001 to the on-site storage tank or vessel and an air bleed connection (not shown) is opened to allow flushing of the load line 2A/2B to vacate it of fluids. The driver stops the process via the control panel, at which point the connections to the transport tank truck are shut in.

At this point all lines are disconnected from the transport tank, and can be disconnected and open ends capped. The transport tank is now ready for transport.

While the present system has been discussed for use in the safe loading and unloading of transport tanks, there are a number of further applications for which one or more elements of the present system can be utilized and taken advantage of. The present system, providing a portable source of purge gas (that is, oxygen deficient medium) can also be transported and used at sites where purging for safe work practice is required. It can also be used in the safe primary loading of stationary vessels.

In an embodiment of the present system, as depicted in FIG. 1, the source of oxygen deficient gas 500; is added to both the fluid load lines 2A/2B for purging the transport tanks; and is also connected to the one or more vapour return lines 4. The one or more vapour return lines 4 connect directly from the transport tanks to an on-site flare stack, there is no scrubber unit and there is no venting to atmosphere. In the embodiment of FIG. 1, purged and displaced gasses and off-gas vapours can be sent directly to a flare or downstream units, thereby reducing vapour emissions being released in vicinity of operators and any other personnel present during loading and unloading.

Oxygen deficient gas 500 is used as a purge gas to purge the vapour content of the transport tank before loading. The oxygen deficient gas is also added as a blend gas directly to the vapour return lines 4 during purging, thereby lowering the oxygen content of the purged gas sufficiently so that it can all be flared, without sending any gas to atmosphere. In such cases the combination of oxygen deficient gas medium into the load lines 2A/2B to purge the vapour content of the transport tank, together with the blending of the displaced gasses with an oxygen deficient medium into vapour return line 4 ensures that the displaced gas is always below the LEL and can always be flared, without the need for an initial period of venting to atmosphere.

Since there is no need to initially vent to atmosphere, there is also no need to scrub vapour content of the transport tank that could be sour or contain hydrogen sulphide. Even sour or hydrogen sulfide containing vapour can be flared. Since the vapour content of the transport tank is brought down below LEL right at the start of purging, gas and vapours displaced from the transport tank during the loading process the can also continue to be directed to a flare, combustion use, pressure vessel or vapour recovery unit. In the present embodiment when purging or loading in sour conditions, the present system allows for vapours to be sent directly to a flare stack, or to downstream units including a vapour recovery unit, a combustion unit for energy generation or back into a pressure vessel that may optionally be provided on-site. Therefore, it is to be understood that for the purposes of the present invention, the term "flare or downstream units" used throughout this description is intended to include flare stack, a vapour recovery unit, a combustion system or a pressure vessel.

With reference to FIG. 1, the oxygen deficient gas source 500 is directed via purge supply line 520 to the load lines. A meter M1 may optionally be included to monitor flow rates and control valve 7101 can control flow rates on oxygen deficient gas to the load lines. In the case of more than one storage tank being on site and more than one load line being provided on the present unit, purge supply line 520 may optionally branch to supply each load lines, as shown in FIG. 3, for example only as lines 520A and 520B. Valving on each branch of purge supply lines 520A and 520B, for example valves 7201 and 7202 on FIG. 3, can be used to direct oxygen deficient gas to the desired load line.

Oxygen deficient gas may be directed via a blend supply line 510 to the vapour return lines 4. A flow meter M2 and flow control valve 7102 may be included on blend supply line 510 to monitor and control flow of oxygen deficient gas into the vapour return line 4.

Flow of oxygen deficient gas into the vapour return line 4 is monitored and controlled to keep oxygen levels in the vapour return below the LEL. As before, an oxygen sensor AIT1001 may be included on the vapour return line 4 to monitor LEL levels.

Figures 2, 4:
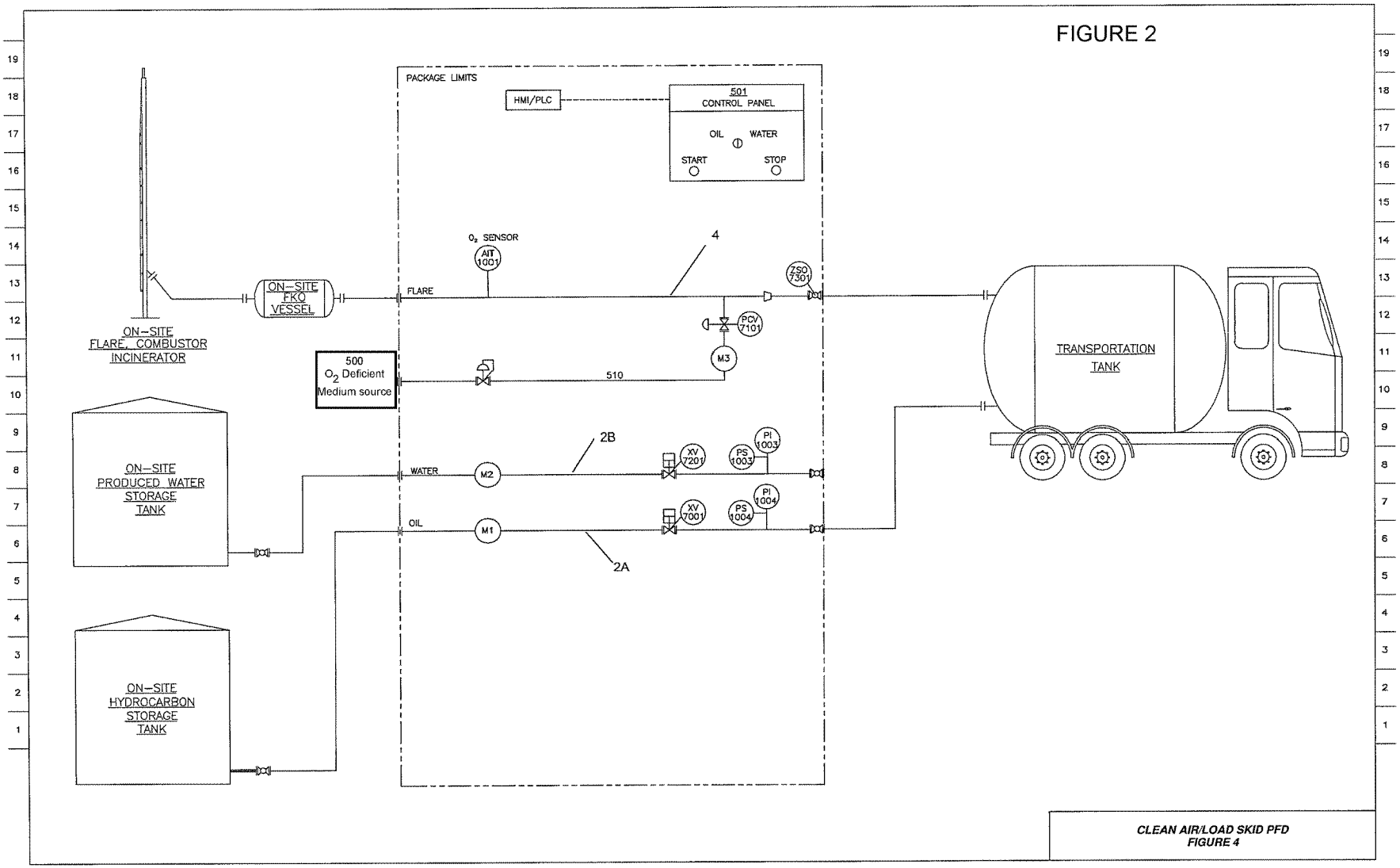
FIG. 2 is a schematic diagram of a second embodiment of a system of the present invention, as connected to on-site storage tanks or vessels and to a transport tank.

The system embodied in FIGS. 1 and 2, preferably comprises the control panel 501 by which the driver can indicate the type of fluid being loaded or unloaded and to start or stop the process. A separate central HMI/PLC can be located on the system, and can be accessed locally or from a remote location from which loading and unloading can be controlled, readings taken and progress displayed.

The present system is fully automated, needing the driver to merely hook up the load and vapour return lines 4, indicate on the control panel the type of fluid being loaded and start the process, at which point the central HMI/PLC, taking input from the pressure and flow monitors, oxygen level monitors and controlling the valving, automatically manages the purging, loading and/or unloading process, until the driver's transport tank level indicator indicates a full load or unload level, or the storage tank is full or empty or from a signal from the fluid metering on the present system, at which point the driver can stop the operation via the control panel.

In the system of FIG. 1, there may be a number of ways to control oxygen levels in the vapour return line. As a first example, at the start of purging the transport tank, valve 7102 on the blend supply line 510 can be set to a predetermined position to ensure a maximum oxygen deficient medium flow into the gas coming off of the purged transport tank. For example pressure in transport tank may determine the position of valve 7102. The supply of oxygen deficient medium is dependent on the content of oxygen in the transport tank vapours being purged. As such, the likely highest levels of oxygen in the transport tank vapours would occur if the transport tank vapours were mainly air, leading to an oxygen content of about 21% in the transport tank vapours. In such cases, a flow rate of oxygen deficient medium in the blend supply line 510 should be set relative to the oxygen deficient medium flow in the purge supply lines to achieve a blend that is below 8% oxygen. It would of course be understood by a person of skill in the art that the flow ratio needed to stay below LEL levels will vary based on composition of vapours being purged, flow rates, temperatures, pressures and other conditions in the vapour return lines 4.

At the beginning of purging the transportation tank, oxygen deficient medium may also be added to the load lines 2A/2B via purge supply lines 520A and 520B. The flow rate of oxygen deficient medium into the load lines 2A/2B will depend on such factors as the pressure or volume of gases in the transportation tank and the desired rate of purging the transportation tank. Valves XV7202 and XV7002 can then slowly be closed as loading begins.

While FIG. 1 shows a single source 500 of oxygen deficient medium, it would be understood by a person of skill in the art that more than one source of oxygen deficient gas may be provided on the present system. Such sources 500 might contain the same or different types of oxygen deficient gas. For example, the load lines 2A/2B may be connected to a source of nitrogen and the vapour return line 4 may be connected to a source of natural gas. As such, the system serves to purge with one type of oxygen deficient medium and blends with another.

Programming in the central HMI/PLC can preferably ensure that the desired flow ratio is maintained and can control valve 7102 to maintain the desired blend supply flow rate. The central HMI/PLC controls valve openings on the purge supply and blend supply lines 520, 510 via valves 7101 and 7102. Flowmeters M1 and M2 and oxygen sensor 1001 are used to verify the operation. The flowmeters M1 and M2 can be used to verify position of control valves 7101 and 7102, and the central HMI/PLC can make minor adjustments to each control valve opening.

Once the oxygen level in the vapour return line 4 is measured at a predetermined low, for example 3% oxygen in the vapour return line 4, it is possible to stop flow from the blend supply line 510 by closing valve 7102. At this point, oxygen deficient medium is only being supplied from the purge supply line 520.

Should for any reason there be no reading from oxygen sensor 1001, it is also possible to maintain necessary flow ratios by reading flow meters M1 and M2 and maintaining a predetermined flowrate of oxygen deficient medium to the load and vapour return lines 4.

Most preferably, all valves for purging or displacing the volume of the tank are automated. The valves may be air actuated valves. As before, the vapour return lines 4 connected with the blending supply line can be used for displacing transport tank volume with oxygen deficient medium during unloading.

More preferably, the oxygen deficient gas is natural gas as both the purge gas and the blending gas.

With no scrubber in the system of FIG. 1, there is no need to monitor chemical supply to a scrubber to avoid depletion.

Typically, once the transportation tank is purged with oxygen deficient medium via purge supply lines 520A and 520B, the tank can be loaded from inside storage tanks or vessels and the displaced vapours, having satisfactorily low oxygen levels, are directed to flare. However, the HMI/PLC may also operate to open valve 7102 during the loading process, after purging, if needed, to ensure the oxygen levels stays below 8% even during a loading. In such cases, oxygen level readings are taken at oxygen sensor AIT1001 and should oxygen levels climb to a predetermined rage, valve 7102 can be opened. For example, should oxygen levels reach 6% the HMI/PLC may start up the blend supply line 510 again.

In the embodiment of FIG. 4, oxygen deficient medium from source 500 is supplied only as a blend gas into the vapour return lines 4 and there is no oxygen deficient medium added to the load lines. In this embodiment, the transportation tank is not purged ahead of loading, instead the load lines 2A/2B load the transportation tank directly upon start of the process. Flow of oxygen deficient medium in the blend line 510 is maximized to lower oxygen content in the displaced gas to below 8% oxygen. Flow rate is monitored through flow meter M3 and oxygen content of the vapour return line is monitored by oxygen sensor 1001 as before.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A system for handling gas emissions during fluids loading or unloading of transport tank, wherein said system comprises:

a. one or more load lines for connecting between on-site storage tanks or vessels and the transport tanks;
b. one or more vapour return lines for connecting between a vent of the transport tanks and an on-site flare or downstream units;
c. an oxygen deficient medium source;
d. one or more oxygen deficient medium blend supply lines connectable to each of the vapour return lines;
e. a HMI/PLC for automation and control of the operations of the system; and
f. a control panel in communication with the HMI/PLC for starting and stopping operation of the system, wherein gases displaced from the transport tanks during loading and transported via the one or more vapour return lines can be blended with oxygen deficient medium via the one or more oxygen deficient medium blend supply lines and sent directly to flare or downstream units with no need for a scrubber.

2. The system of claim 1, wherein the vapour return lines each further comprise an oxygen sensor located downstream of the blend supply line connection, for monitoring oxygen levels in the vapour return lines.

3. The system of claim 2, wherein the blend supply lines each further comprises a flowmeter for monitoring flow of oxygen deficient medium and a control valve for controlling flow of oxygen deficient medium.

4. The system of claim 3, wherein the oxygen deficient medium is connectable via one or more purge supply lines to each of the load lines for purging of the transport tank prior to loading.

5. They system of claim 4, wherein the purge supply lines each further comprises a flowmeter for monitoring flow of oxygen deficient medium and a control valve for controlling flow of oxygen deficient medium.

6. The system of claim 1, wherein said system is fixed on-site.

7. The system of claim 1, wherein said system is portable.

8. A method for handling gas emissions during fluids loading or unloading from one or more on-site storage tanks or vessels to one or more transport tanks, said method comprising the steps of:

a. providing a loading system comprising one or more load lines connectable between the storage tanks or vessels and the transport tanks, one or more vapour return lines connectable between a vent of the transport tanks and a flare, a source of oxygen deficient medium connectable via one or more blend supply lines to the one or more vapour return lines, and a central HMI/PLC;
b. loading the transport tank with fluid;
c. carrying gases displaced from the transport tank during loading in the one or more vapour return lines;
d. blending the one or more vapour return lines with oxygen deficient medium;
e. sending gases blended with oxygen deficient medium and carried by the one or more vapour return lines directly to flare or downstream units with no need for scrubbing; and
f. automatically monitoring and controlling of the operations of the system via the HMI/PLC.

9. The method of claim 8, further comprising the steps of purging the transport tank with oxygen deficient medium via the load lines prior to loading.

10. The method of claim 9, wherein purging the transport tank further comprises:

a. connecting at least one of said one or more vapour return lines to a vent of the transport tank;
b. connecting at least one of said one or more load lines to the transport tank;
c. connecting one or more purge supply lines from said source of oxygen deficient gas to the one or more load lines;
d. connecting blend supply lines from said source of oxygen deficient gas to the one or more vapour return lines; and
e. flowing oxygen deficient medium through the load lines and through the vapour return lines.

11. The method of claim 10, further comprising the steps of:

a. automatically conducting via the central HMI/PLC, the steps of:
   i. opening a valve on the purge supply line to the load line;
   ii. opening a valve on the blend line to provide oxygen deficient medium to the vapour line;
   iii. purging the transport tank with oxygen deficient medium;
   iv. opening the vapour line to flare or downstream units;
   v. monitoring oxygen content in the vapour line;
   vi. opening load lines to load fluid from the on-site storage tank or vessel to the transport tank;
   vii. at the end of loading, closing the load line connection to the on-site storage tank or vessel;
b. stopping the system via the control panel; and
c. disconnecting vapour return lines and load lines from the transport tank.

12. The method of claim 8, wherein said system is fixed on-site.

13. The method of claim 8, wherein said system is portable.

* * * * *